United States Patent [19]

Dessau et al.

[11] Patent Number: 4,650,917

[45] Date of Patent: Mar. 17, 1987

[54] METHOD FOR UPGRADING OLEFINIC LUBES

[75] Inventors: Ralph M. Dessau, Edison; David H. Olson, Pennington, both of N.J.

[73] Assignee: Mobil Oil Corporation, New York, N.Y.

[21] Appl. No.: 766,996

[22] Filed: Aug. 19, 1985

[51] Int. Cl.[4] ..... C07C 5/27; C07C 5/22; C07C 5/23

[52] U.S. Cl. ..... 585/329; 585/326; 585/525; 585/532; 585/666; 585/667; 585/671; 585/739; 585/740; 585/826; 585/829; 208/310 Z

[58] Field of Search ..... 585/326, 329, 666, 687, 585/671, 532, 525, 826, 829, 739, 740; 208/310 Z

[56] References Cited

U.S. PATENT DOCUMENTS

| | | | |
|---|---|---|---|
| 3,149,178 | 9/1964 | Hamilton et al. | 585/255 |
| 3,726,938 | 4/1973 | Berger | 585/667 |
| 3,833,678 | 9/1974 | Brennan | 585/532 |
| 4,032,591 | 6/1977 | Cupples et al. | 585/643 |
| 4,269,695 | 5/1981 | Silk et al. | 585/739 |
| 4,309,281 | 1/1982 | Dessau | 585/820 |
| 4,440,871 | 4/1984 | Lok et al. | 585/740 |
| 4,487,688 | 12/1984 | Dessau | 585/826 |
| 4,501,926 | 2/1985 | LaPierre et al. | 585/739 |
| 4,554,065 | 11/1985 | Albinson et al. | 585/739 |

FOREIGN PATENT DOCUMENTS 1075305 7/1967 United Kingdom .

OTHER PUBLICATIONS

J. A. Brennan, "Wide-Temperature Range Synthetic Hydrocarbon Fluids", Ind. Eng. Chem. Prod. Res. Dev. 1980, 19, 2-6.

R. L. Shubkin et al, "Olefin Oligomer Synthetic Lubricants: Structure and Mechanism of Formation", Ind. Eng. Chem. Prod. Res. Dev. 1980, 19, 15-19.

*Primary Examiner*—Asok Pal

*Attorney, Agent, or Firm*—A. J. McKillop; M. G. Gilman; L. P. Hobbes

[57] ABSTRACT

The viscosity index of synthetic lubricant stocks such as those produced by olefin oligomerization is increased by contacting such stocks with a solid acidic isomerization catalyst such as boron trifluoride at elevated temperatures, say above about 200° C. The high viscosity index fractions of the resulting product may be sorbed by a shape-selective zeolite such as ZSM-5 and recovered to produce a high VI lubricant.

26 Claims, No Drawings

METHOD FOR UPGRADING OLEFINIC LUBES

This invention relates to a process for making lubricants and more particularly, to a method for enhancing the viscosity index of synthetic lubestocks by contacting them with a solid acidic catalyst under isomerization conditions.

Viscosity index (VI) is an important characteristic of lubricants, especially hydrocarbon lubricants since it provides a measure of the extent to which the viscosity of the lubricant will vary with temperature. Normally, a high viscosity index, indicative of a relatively lower rate of change of viscosity with temperature, is desired in a lubricant because it will then be possible not only to predict the performance of the lubricant over a wider range of conditions but, in addition, the allowances which will have to be made for variations in lubricant properties will be smaller so that the design characteristics of machinery can be optimized to a greater degree. It has long been known that the viscosity index (VI) of a hydrocarbon lubricant is related to its structure: paraffins have the highest indices and among the paraffins the more highly branched the paraffins is, the lower will be its viscosity index. For this reason, the more linear paraffinic lubricants have traditionally been preferred for their high viscosity index although the extent to which they may be employed in practical, commercial lubricants is limited by the fact that these same materials also tend to have high pour points, itself an undesirable feature. In practice, this has meant that a compromise must normally be found between the desirable attributes of high viscosity index and low pour point, and generally the problem has found its practical solution in the use of dewaxed oils of paraffinic origin in which the linear and slightly branched paraffins have been removed by the dewaxing process which leaves sufficient amounts of the slightly more highly branched paraffins to confer a high viscosity index without raising the pour point to unacceptable levels. Processes of this kind, however, require a base stock having adequate amounts of the less highly branched paraffins and sufficiently free of the more highly branched paraffins in order to confer the desired high viscosity index and low pour point. Base stocks of this kind may not always be available and some method must therefore be found for their manufacture.

In recent years lubricant stocks have been prepared by oligomerization of olefins to liquid polymers. This procedure is described, for example, in U.S. Pat. Nos. 3,149,178 and 3,833,678, British Pat. No. 1,075,305, Ind. Eng. Chem. Prod. Res. Dev. 1980, 19, 2–6 and 15–19, all of which are incorporated herein by reference. A wide variety of olefins can be polymerized with the stable catalyst solution of this invention. In general, they can contain between about two and twenty-five carbon atoms per molecule and can be straight chain or branched chain, with or without aromatic ring substituents. Although preferred olefins are the 1-olefins, olefins having internal double bonds may be employed. The olefin reactant can be a single olefin or a mixture of olefins, of which the following are nonlimiting examples: ethylene; butene-1; isobutene; hexene; octene-2; 2-ethylhexene-1, decene-2; decene-1; undecene-1; dodecene-1; hexadecene-1, octadecene-1; octadecene-9; eicosene; tricosene-1; tetracosene-1; and triacontene-1.

A preferred type of lubricant feedstock is provided for, however, by the oligomerization of light, shorter chain ($C6^{31}$) olefins such as propylene and butylene. The oligomerization process may be carried out over various acidic catalysts. These catalysts include materials selected from the group of Lewis acids such as the aluminum halides, boron halides, stannic halides, and hydrofluoric acid. Preferred Lewis acids for use as oligomerization catalyst include $AlCl_3$ and $BF_3$.

The oligomerization may be carried out at temperatures of between about −80° C. and about 100° C.for a sufficient period of time to effect oligomerization, say about 1–3 hours. Ordinarily oligomerization is carried out at substantially atmospheric pressure, but particularly with lower olefins, superatmospheric pressures sufficient to maintain liquid phase can be advantageously employed. The amount of catalyst employed will generally be about 1–5 percent by weight of olefin. In some operations, in order to render products less viscous and more readily handled, a solvent inert to the oligomerization can be used. Suitable solvents include kerosene and paraffins, such as heptane, octane, isooctane, decane, etc. Preferably, the lubricant feedstock employed in the method of the present invention is obtained by the oligomerization of a feedstock containing $C_3$ to $C_5$ olefins. The synthetic lubricant stock treated by the present invention may have an initial boiling point of at least 340° C., and a viscosity index of less than 30.

Generally, although the products of lower temperature oligomerization are formed in high yields and good pour point, they exhibit poor viscosity index due to the high degree of branching. Accordingly, it would be desirable to treat these products of low temperature oligomerization in such a way as to increase their viscosity indices.

It has now been found that the relative content of lesser-branched components in a synthetic lubricant stock, such as single methyl-branched isomers, which enhance viscosity index, increases as the temperature of reaction increases. Accordingly, the present invention relates to a method for preparing synthetic lubricant stocks of enhanced viscosity index which comprises contacting a synthetic lubricant stock, containing highly branched olefinic hydrocarbons, with a solid acidic isomerization catalyst under isomerization conditions. Such conditions include an isomerization temperature greater than about 150° C. or even 250° C., for example, ranging between about 150° and 400° C. The isomerization is conducted such that the viscosity index of the resulting lubricant stock is increased. Alternatively, the present invention can be described as a method for improving the viscosity index of a synthetic lubricant stock produced by the low temperature oligomerization of olefins by contacting the stock with an acidic oligomerization catalyst. The lubricant stock is treated by contact with an acidic isomerization catalyst at an isomerization temperature of about 150° to 400° C. such that the viscosity index of the resulting lubricant stock is increased.

In one preferred embodiment of the invention, the lubricant stock resulting from isomerization is treated in accordance with a process disclosed in U.S. Pat. No. 4,487,688 to Dessau, the entire content of which is incorporated herein by reference. After isomerization at elevated temperatures, the lubestock is contacted under sorption conditions with a crystalline zeolite having a silica to alumina mole ratio of at least about 12 and a constraint index of about 1 to 12 such that high viscosity index fractions are sorbed onto the zeolite. The zeolite may thereafter be desorbed to recover a lubestock fraction of high viscosity index, say greater than about 30. This fraction may be combined with lower quality lubestocks in order to provide a product of higher viscosity index. The non-sorbed fraction may be cycled to the isomerization zone where it is contacted with the acidic isomerization catalyst at elevated temperatures. The final product may be hydrogenated by conventional means to increase stability by diminishing the reactive olefin content.

The present invention may also be described as a method for preparing synthetic lubricant stocks of enhanced viscosity index. A synthetic lubricant stock containing olefinic linear and branched chain hydrocarbons and having an initial viscosity index less than about 30 is contacted with a solid acidic isomerization catalyst at an isomerization temperature of greater than about 150° C. such that the viscosity index of the resulting lubricant stock is increased. Preferably, the isomerization temperature ranges between about 150° to 400° C., preferably between about 200° to 300° C. The viscosity index of the resulting lubricant stock may be increased by at least about 5, say 10 or more to a viscosity index of at least about 30, for example, a viscosity index ranging between about 30 to 50, say at least about 40.

The isomerization catalyst may include any suitable acidic catalyst, including solids such as catalytically active inorganic oxide-containing materials. Such materials may include amorphous inorganic oxides, such as alumina or silica-alumina, or molecular sieve materials having acidic catalytic activity such as the silicoaluminophosphates (SAPOs), e.g. SAPO-5 described in U.S. Pat. No. 4,440,871; or zeolites. The zeolites may include large pore zeolites having a constraint index less than about 2 such as zeolite L, zeolite X, zeolite Y, zeolite beta, described in U.S. Pat. No. 3,308,069, ZSM-4, described in U.S. Pat. No. 3,578,723, ZSM-12, described in U.S. Pat. No. 3,832,449 and ZSM-20, described in U.S. Pat. No. 3,972,983, all of said patents being incorporated herein by reference. In addition, shape-selective zeolites having a constraint index of 1 to 12 such as ZSM-5, ZSM-11, ZSM-5/ZSM-11 intermediate, ZSM-23, ZSM-35, ZSM-38, and ZSM-48 are also suitable. Preferably, these materials may be ion-exchanged with hydrogen, rare earth metals or any other suitable material which imparts an acidic character to the catalyst. Hydrogen-exchanged zeolite beta and rare earth-exchanged zeolite X are particularly preferred.

When the isomerization product is further treated by sorption of higher VI fractions with a highly siliceous zeolite, the temperature at which the sorption process is conducted is not critical as long as it is maintained below that required for chemical reaction to occur, e.g. below cracking temperature. The temperature should thus be maintained below about 100° C. when an acidic zeolite is used (e.g. having an alpha value greater than 10). A method for determining alpha is described in U.S. Pat No. 4,016,218 and J. Catalysis VI, 278–287, 1966 to which reference is made for details of the method. When a relatively non-acidic zeolite is used, e.g. one having a $SiO_2/Al_2O_3$ mole ratio of about 1000:1 or more, or when the zeolite has been converted to the alkali metal-containing form, e.g. Na, by ion-exchange, for instance, higher temperatures may be used, such as up to about 400° C. Preferably, the process is conducted in the temperature range between ambient and about 150° C.

The components of the feed which have become sorbed on the zeolite may be recovered by conventional desorption techniques such as steam stripping or solvent extraction. The process may be carried out in a batch operation or in a continous (flow type) sequence, e.g. a continuous chromatographic type operation.

The zeolites used in the sorption process have a Constraint Index of 1 to 12 and a silica:alumina ratio of at least 12. Because the hydrophobic characteristics, i.e. the affinity for hydrocarbons, are related to the silica:alumina ratio, it is preferred that the zeolites with higher silica:alumina ratios should be used. The silica:alumina ratio will frequently be at least 30:1 but higher ratios, e.g. 1600:1, may also be used; the silica:alumina ratio of these materials may, in fact, go to infinity.

Specific zeolites conforming to the prescribed values of Constraint Index and silica:alumina ratio include ZSM-5, ZSM-11, ZSM-12, ZSM-23, ZSM-35, ZSM-38, the ZSM-5/ZSM-11 intermediate and ZSM-48 which are disclosed, respectively in U.S. Pat. Nos. 3,702,886; 3,709,769; 3,832,449, 4,076,842; 4,016,245, 4,046,859, 4,229,424 and 4,375,573. Highly siliceous forms of ZSM-5 are disclosed in U.S. Pat No. Re. 29,948. Reference is made to these patents for complete details of these zeolites and the preparation. Of them, ZSM-5 is preferred.

The invention is illustrated by the Example given below in which all parts, percentages and proportions are expressed by weight, unless the contrary is stated. In these Examples, the degree of chain branching has been used as a measure of the viscosity index of the lubricant since it has been found that there is a reasonable inverse correlation between viscosity index and the degree of chain branching in paraffinic hydrocarbon lubricants. In order to provide a numerical measurement of the degree of chain branching, the ratio R* of methylene to methyl protons in the various fractions is used. This ratio is determined by simple measurement of the NMR peak heights of the methylene and methyl protons, respectively. The higher the value of R*, the more linear (less branched) is the molecule and hence its viscosity index. Other methods of measuring the degree of chain branching may, of course, be used to establish a correlation with viscosity index.

EXAMPLE 1

A 343° C.+(650° F.+) olefinic lube fraction was produced by room temperature (25° C.) oligomerization of propylene over a $BF_3$-containing acidic resin catalyst. The viscosity index of the oligomerized product was determined to be about 30.

The olefinic lube fraction was isomerized in an isomerization zone by contact with an unbound hydrogen-exchanged zeolite beta catalyst in a batch reactor at about 230° C., and about 0 psig, for about 14.5 hours during which time samples A, B, and C were withdrawn from the reactor.

Evidence for reisomerization to lesser-branched mixtures was indicated by subjecting samples A, B, and C as well as the oligomerization product to proton NMR studies which revealed increasing ratios of methylene to methyl protons as the reaction progressed, thus indicating greater degrees of linearity as well as higher VI properties for lubes produced by olefin oligomerization. The results of the NMR studies are set out below.

| Sample | Reaction Time (hrs.) | R* = Methylene Proton NMR Peak Height/Methyl Proton NMR peak Height |
|---|---|---|
| 30 VI Lube | 0 | 0.465 |
| A | 2 | 0.505 |
| B | 6.5 | 0.533 |
| C | 14.5 | 0.566 |

EXAMPLE 2

Sample C of Example 1 is subjected to selective sorption by a ZSM-5 zeolite having a silica to alumina mole ratio of 70 using bulky solvents tetramethylsilane (TMS) and mesitylene (1,3,5-trimethylbenzene). The sorptions are carried out at room temperature with the TMS solvent and at 162° C. under reflux with the mesitylene. The sorbed fractions are recovered from the zeolite by desorption with n-hexane by continuous extraction in a Soxhlet type apparatus. The R* values of the sorbed and non-sorbed fractions are about 0.6 and about 0.5 respectively. The non-sorbed fraction is thereafter recycled to the isomerization zone.

It is claimed:

1. A method for improving the viscosity index of a synthetic lubricant stock produced by oligomerization of olefins in the presence of an acidic oligomerization catalyst at oligomerization temperatures of less than about 100° C., which method comprises contacting said lubricant stock with an acidic isomerization catalyst in an isomerization zone at an isomerization temperature of about 150 to about 400° C. such that the relative content of lesser branched hydrocarbons is increased and the viscosity index of the resulting lubricant stock is increased.

2. The method of claim 1 wherein said lubricant stock is produced by oligomerization of a feedstock containing $C_3$ to $C_5$ olefins.

3. The method of claim 2 wherein said oligomerization catalyst comprises a Lewis acid.

4. The method of claim 3 wherein said Lewis acid is selected from the group consisting of $BF_3$ and $AlCl_3$.

5. The method of claim 3 wherein said Lewis acid is $BF_3$.

6. The method of claim 1 wherein said acidic isomerization catalyst is an amorphous inorganic oxide selected from the group consisting of alumina and silica/alumina.

7. The method of claim 1 wherein said acidic isomerization catalyst is a silicoaluminophosphate.

8. The method of claim 1 wherein said acidic isomerization catalyst is a zeolite having a constraint index less than about 2.

9. The method of claim 8 wherein said zeolite is selected from the group consisting of zeolite L, zeolite X, zeolite Y, zeolite beta, ZSM-4, ZSM-12 and ZSM-20.

10. The method of claim 1 wherein said acidic isomerization catalyst is a zeolite having a constraint index of about 1 to 12.

11. The method of claim 10 wherein said zeolite is selected from the group consisting of ZSM-5, ZSM-11, ZSM-5/ZSM-11 intermediate, ZSM-23, ZSM-35, ZSM-38 and ZSM-48.

12. The method of claim 9 wherein said zeolite is hydrogen-exchanged zeolite beta.

13. The method of claim 9 wherein said zeolite is rare earth-exchanged zeolite X.

14. The method of claim 1 wherein said oligomerization temperature ranges between about 0° and 100° C. and said isomerization temperature ranges between about 200° to 300° C.

15. The method of claim 1 wherein said synthetic lubricant stock has an initial boiling point of at least about 340° C. and viscosity index of less than about 30 and said resulting lubestock has a viscosity index of at least about 40.

16. The method of claim 1 wherein said resulting lubestock is contacted under sorption conditions with a crystalline zeolite having a silica to alumina mole ratio of at least about 12 and a constraint index of about 1 to 12 to sorb the high viscosity index fractions on the zeolite.

17. The method of claim 16 wherein said sorption conditions include a temperature below about 100° C. and said zeolite has an alpha value less than about 10.

18. The method of claim 16 wherein said sorbed fractions are recovered from the zeolite.

19. The method of claim 18 wherein said sorbed fractions are recovered from the zeolite by solvent extraction.

20. The method of claim 16 wherein the unsorbed fraction of said lubestock is cycled to said isomerization zone.

21. A method for preparing synthetic lubricant stocks of enhanced viscosity index which comprises contacting a synthetic lubricant stock containing linear and branched chain olefinic hydrocarbons with a solid acidic isomerization catalyst in an isomerization zone at an isomerization temperature greater than about 150° C. such that the relative content of lesser branched hydrocarbons is increased and the viscosity index of the resulting lubricant stock is increased.

22. The method of claim 21 wherein said viscosity index of the resulting lubricant stock is increased by at least about 5.

23. The method of claim 21 wherein said resulting lubricant stock is contacted with a crystalline zeolite having a silica to alumina mole ratio of at least about 12 and a constraint index of about 1 to 12 to sorb the high viscosity index fraction on the zeolite.

24. The method of claim 23 wherein said zeolite is selected from the group consisting of ZSM-5, ZSM-11, ZSM-12, ZSM-23, ZSM-35, ZSM-38 and ZSM-48.

25. The method of claim 24 wherein said zeolite is ZSM-5.

26. The method of claim 23 wherein the unsorbed fraction of said resulting lubricant stock is cycled to said isomerization zone.

* * * * *

UNITED STATES PATENT AND TRADEMARK OFFICE

CERTIFICATE OF CORRECTION

PATENT NO. : 4,650,917

DATED : March 17, 1987

INVENTOR(S) : Ralph M. Dessau et al

It is certified that error appears in the above-identified patent and that said Letters Patent is hereby corrected as shown below:

Col. 2, line 1, "$C6^{31}$ should be --$C^{6-}$--

Signed and Sealed this

Fifteenth Day of September, 1987

*Attest:*

DONALD J. QUIGG

*Attesting Officer*

*Commissioner of Patents and Trademarks*